United States Patent [19]

Peters et al.

[11] 4,120,710

[45] * Oct. 17, 1978

[54] NITROALIPHATIC DIFLUOROFORMALS

[75] Inventors: Howard M. Peters, Palo Alto; Robert L. Simon, Jr., San Carlos, both of Calif.

[73] Assignee: The United States of America as represented by the United States Department of Energy, Washington, D.C.

[ * ] Notice: The portion of the term of this patent subsequent to Nov. 25, 1992, has been disclaimed.

[21] Appl. No.: 641,320

[22] Filed: Dec. 16, 1975

[51] Int. Cl.[2] ..... C06B 25/00; C07C 43/04

[52] U.S. Cl. ..... 149/88; 260/615 A; 260/615 F

[58] Field of Search ..... 260/615 A, 615 F; 149/88

[56] References Cited

U.S. PATENT DOCUMENTS

| | | | |
|---|---|---|---|
| 3,388,147 | 6/1968 | Kamlet et al. | 149/88 X |
| 3,396,187 | 8/1968 | Benzinger et al. | 149/88 X |
| 3,922,311 | 11/1975 | Peters | 149/88 X |
| 3,962,349 | 6/1976 | Adolph | 149/88 X |

OTHER PUBLICATIONS

Aldrich et al., *J. Org. Chem.*, 29, 11–15 (1964).

Shipp et al., *J. Org. Chem.*, 31, 853–856 (1966).

*Primary Examiner*—Edward A. Miller

*Attorney, Agent, or Firm*—Dean E. Carlson; R. S. Gaither; Irene S. Croft

[57] ABSTRACT

Nitroaliphatic difluoroformals of the formula $RCH_2OCF_2OCH_2R'$ wherein $R = FC(NO_2)_2$— and $R' = F_2C(NO_2)$— or $CF_3$—; or $R = R' = CF_3OCH_2C(NO_2)_2$—. The compounds are prepared in accordance with the following reaction:

$$RCH_2OCO_2CH_2R' \xrightarrow[HF]{SF_4} RCH_2OCF_2OCH_2R'$$

carried out at temperatures of from about 95° C to about 150° C. The compounds are especially useful as energetic plasticizers in explosive compositions.

6 Claims, No Drawings

NITROALIPHATIC DIFLUOROFORMALS

The invention described herein was made under, or in the course of, Energy Research and Development Administration Contract No. AT(04-3)-115, Project Agreement Nos. 89 and 94, with Stanford Research Institute.

BACKGROUND OF THE INVENTION

The present invention relates to nitroaliphatic difluoroformals and processes for the preparation thereof.

Plastic bonded explosives, often referred to as PBX, are widely used in military and civilian applications. Such explosive compositions generally comprise a suitable explosive such as HMX (cyclo-1,3,5,7-tetramethylene-2,4,6,8-tetranitramine), RDX (cyclo-1,3,5-trimethylene-2,4,6-trinitramine), etc., in particle sizes in the range of about 2 to 30 microns dispersed in a suitable explosively energetic fluid phase with a thickener such as colloidal silica or together with a suitable plastic binder, such as an acrylic resin material, and an energetic plasticizer which confers a plastic quality which enables the explosive composition to withstand mechanical shock or thermal changes without fracturing. The plasticizer may also improve molding properties to facilitate fabrication. A suitable plasticizer should have low volatility and a wide temperature range at which the material remains liquid, i.e., a low glass transition temperature, so as to avoid phase changes which might disrupt the explosive, and, desirably, it should contribute to the explosive energy of the PBX composition.

Such plastic explosive compositions are described in detail in U.S. Pat. No. 3,480,490, "Multiphase Extrudable Explosives", issued Nov. 25, 1969, to Milton Finger et al. The plasticizers disclosed therein include liquid explosives of the gem-dinitroaliphatic hydrocarbon class, a particularly useful one being bis(2-fluoro-2,2-dinitroethyl)formal or FEFO. The use of the related compound bis(2-fluoro-2,2-dinitroethyl) difluoroformal or difluoro-FEFO as a plsticizer is disclosed in our application "Fluorodinitroethyl Difluoroformal and Process of Manufacture", Ser. No. 251,878, filed May 10, 1972, now U.S. Pat. No. 3,922,311 issued Nov. 25, 1975.

The synthesis of certain difluoroformals using sulfur tetrafluoride and hydrogen fluoride maintained at temperatures of about 200° to 250° C. for 10 hours has been reported by Aldrich and Sheppard, *J. Org. Chem.*, 29 11 (1964). The synthesis of bis(2-fluoro-2,2-dinitroethyl) difluoroformal using sulfur tetrafluoride and hydrogen fluoride wherein the molar ratio of $SF_4$ to HF is less than 1 and reaction temperature is maintained in the range of 95° to about 125° C. is described in the above-cited copending application.

SUMMARY OF THE INVENTION

The present invention relates to nitroaliphatic difluoroformals of the formula $RCH_2OCF_2OCH_2R'$ wherein $R = FC(NO_2)_2$— and $R' = F_2C(NO_2)$— or $CF_3$—; or $R = R' = CF_3OCH_2C(NO_2)_2$—.

Specifically, when $R = FC(NO_2)_2$— and $R' = F_2C(NO_2)$— or $CF_3$—, the resulting compounds are the unsymmetrical difluoroformals 1,1,4,4,7-pentafluoro-1,7,7-trinitro-3,5-dioxaheptane (MFF) and 1,1,1,4,4,7-hexafluoro-7,7-dinitro-3,5-dioxaheptane (TFMFF), respectively. When $R = R' = CF_3OCH_2C(NO_2)_2$—, the resulting compound is the symmetrical difluoroformal 1,1,1,7,7,13,13,13-octafluoro-4,4,10,10-tetranitro-2,6,8,12-tetraoxadecane (OTT). The unsymmetrical difluoroformals are especially suitable as energetic plasticizers for explosive compositions.

The present compounds are prepared from the corresponding carbonates in accordance with the following general reaction:

$$RCH_2OCO_2CH_2R' \xrightarrow[HF]{SF_4} RCH_2OCF_2OCH_2R'$$

$SF_4$ and HF form a complex under most reaction conditions, and the actual reactive species may be $H^+SF_5^-$.

It has now been found that exceptionally high yields of $FC(NO_2)_2CH_2OCF_2OCH_2C(NO_2)F_2$ (1,1,4,4,7-pentafluoro-1,7,7-trinitro-3,5-dioxaheptane or MFF) can be obtained from the corresponding carbonate, $FC(NO_2)_2CH_2OCO_2CH_2C(NO_2)F_2$, by the above reaction when the molar amount of HF approaches but does not exceed that of $SF_4$. It has further been found that when the molar amount of HF exceeds that of $SF_4$, the reaction of $FC(NO_2)_2CH_2OCO_2CH_2C(NO_2)F_2$ with $SF_4$ and HF produces, in addition to MFF, the unsymmetrical difluoroformal $FC(NO_2)_2CH_2OCF_2OCH_2CF_3$ (1,1,1,4,4,7-hexafluoro-7,7-dinitro-3,5-dioxaheptane or TFMFF) in substantial quantities.

For preparing the present difluoroformals, the starting carbonate is preferably deposited in a cooled, evacuated autoclave. Then the requisite amount of $SF_4$ and anhydrous hydrogen fluoride may be condensed therein at low temperature. The autoclave is then sealed and heated to a temperature of about 95°–150° C. for an extended period of time whereupon reaction occurs. After cooling to ambient temperature and venting of the toxic gases, the reaction mixture may be mixed with methylene chloride solvent and the product purified by treating with sodium fluoride, washing with saturated sodium bicarbonate solution, and decolorizing with decolorizing charcoal, e.g., Norit.

The final product may then be used as a highly energetic plasticizer in compounding PBX formulations similarly to those described above, thereby providing superior formulations which retain appropriate plastic and other properties and have superior storage over wide temperature ranges as well as being somewhat more energetic.

Accordingly, it is an object of this invention to provide novel nitroaliphatic difluoroformals and methods for the preparation thereof.

Another object of the invention is to provide an energetic plasticizer or fluidic dispersant material for formulating plastic explosive compositions.

Still another object of the invention is to provide nitroaliphatic difluoroformals for use in formulating PBX compositions.

Other objects and advantageous features of the invention will be apparent from the following detailed description.

DETAILED DESCRIPTION OF THE INVENTION

The invention is described in detail with reference to each of the difluoroformals of the present invention.

I.

1,1,4,4,7-PENTAFLUORO-1,7,7-TRINITRO-3,5-DIOXAHEPTANE (MFF)

MFF is prepared by reacting 2-fluoro-2,2-dinitroethyl-2',2'-difluoro-2'-nitroethyl carbonate, hereinafter referred to as mixed carbonate, with $SF_4$ and HF, preferably at a temperature in the range of from about 95° C. to about 150° C. It has been found that optimum yields of MFF are obtained when the molar amount of HF approaches but does not exceed that of $SF_4$, as outlined by the following reaction.

$$\underset{\text{(mixed carbonate)}}{FC(NO_2)_2CH_2OCO_2CH_2C(NO_2)F_2} \xrightarrow[HF]{\text{excess } SF_4} \underset{\text{(MFF)}}{FC(NO_2)_2CH_2OCF_2OCH_2C(NO_2)F_2}$$

The starting carbonate can be synthesized by the procedure outlined in the following equations.

$$1.\ CF(NO_2)_2CH_2OH + COCl \xrightarrow{\text{pyridine}} CF(NO_2)_2CH_2OCOCl$$

$$2.\ CF_2{=}CClF + N_2O_4 + H_2O \longrightarrow F_2C(NO_2)COOH$$

$$F_2C(NO_2)COOH + OH^- + CH_2O \longrightarrow F_2C(NO_2)CH_2OH$$

$$3.\ FC(NO_2)_2CH_2OCOCl + F_2C(NO_2)CH_2OH \,.\, C_5H_5N \longrightarrow FC(NO_2)_2CH_2OCO{-}OCH_2CF_2(NO_2)$$

A specific procedure for the synthesis of mixed carbonate is outlined as follows:

1. Preparation of 2-fluoro-2,2-dinetroethyl chloroformate

This material can be prepared by the process described by Horst G. Adolph in *J. Org. Chem.* 37 (5), 747 (1972). However, the method exemplified as follows is preferred.

Phosgene (800 g, 8.0 mol) and 2-fluoro-2,2-dinitroethanol (500 g, 3.2 mol) were dissolved in 2400 ml methylene chloride and cooled to 0°-5° C. Pyridine (260 g, 3.3 mol), dissolved in 2000 ml methylene chloride, was placed into a jacketed addition funnel that was cooled by circulating ice water through it. The pyridine was then added over a 30-minute period. The reaction was stirred for 1 hour and the methylene chloride removed under vacuum, leaving a yellow semisolid material. The pyridinium hydrochloride was removed by dissolving the chloroformate in ether, leaving a white solid precipitate. The pyridinium hydrochloride precipitate was filtered and washed well with ether. The ether was removed under vacuum, leaving 638 g (91%) crude product. The crude material was distilled and the chloroformate collected at 29° C. (0.1 mm) as a colorless liquid (504 g, 71% yield).

2. Preparation of 2,2-difluoro-2-nitroethanol

This material can be prepared by the process exemplified as follows.

A 5-liter 4-neck flask was fitted with a stirrer, gas inlet tube reaching close to the bottom of the vessel, thermometer, and a coldfinger type condenser with drying tube. 2000 ml dried methylene chloride was placed in the flask, cooled to about −10° C. with an acetone-Dry Ice bath, and 400 g liquid $N_2O_4$ was added. At −10°±2° C. a rapid stream of chlorotrifluoroethylene was introduced with stirring until all $N_2O_4$ was used up. At this point, brown fumes were no longer visible in the gas phase above the solution, and the solution itself turned from a green color (during most of the reaction) to a deep purple blue. During the addition of the chlorotrifluoroethylene, the goldfinger was charged with pulverized Dry Ice or Dry Ice-acetone mixture to prevent the escape of condensable material from the vessel. At the end of the reaction the mixture was allowed to warm gradually to −5° C. and was stirred at this temperature for 0.5-1 hr. Then 1200 g crushed ice was added rapidly, and the mixture was stirred overnight without further cooling. The phases were separated and the organic phase was extracted with two 150 ml portions of water. The combined aqueous phases constitute an aqueous solution of difluoronitroacetic acid (CAUTION: this material is reported to be highly toxic).

This acid solution was neutralized with cooling to 15° C. by the gradual addition of 275 g KOH; and additional 50 g KOH was added to make the solution strongly basic, followed by 462 ml 36% aqueous formaldehyde. The mixture was stirred for 24 hr at 45°-50° C.; after the first few hours the pH of the solution dropped and two additional 15 g quantities of KOH were added (CAUTION: strong gassing). The mixture was then cooled in an ice-bath neutralized with sulfuric acid (prepared by pouring concentrated sulfuric acid over crushed ice) (CAUTION: gassing), and extracted with five 300 ml portions of ether. The combined ether solutions were dried ($MgSO_4$), filtered, and most of the ether was boiled off. Methylene chloride, 500 ml, was added to the residue and the solution was stirred for several hours with crushed molecular sieves (4A), filtered, the solvent boiled off, and the residue distilled to give 165 g (30% based on $N_2O_4$) difluoronitroethanol, b.p. 65° C./20 mm. The purity of the product varied from 93-98% over several runs.

3. Preparation of mixed carbonate

This material can be prepared by the process exemplified as follows.

2-Fluoro-2,2-dinitroethyl chloroformate (179 g) and 2,2-difluoro-2-nitroethanol (105 g) were dissolved in 500 ml dried methylene chloride and cooled to 5° C. Pyridine (71.5 g) was added dropwise to the reaction mixture with stirring. After the addition was complete, the mixture was allowed to warm gradually to room temperature, was stirred overnight, and then heated to reflux for 4-5 hours. It was washed with dilute sulfuric acid and water, dried ($MgSO_4$), and the solvent removed under vacuum. A crude carbonate (240 g, 95% yield) of between 90 and 95% purity was obtained. Further purification of this material can be effected by recrystallization from a 40/60 methylene chloride/hexane mixture at Dry Ice temperature, or fractional distillation in small batches. The purified carbonate had a melting point of 24°-25° C. and a boiling point of about 80° C./0.1 mm.

In accordance with the process of the present invention, maximum yield of MFF is obtained by reacting mixed carbonate with $SF_4$ and HF with an $SF_4$ : HF mole ratio > 1. The process of the present invention is illustrated in Example I.

EXAMPLE I

Mixed carbonate (184 g, 0.6 mol) was placed in a 1400-ml 347 stainless steel autoclave. The autoclave was evacuated (0.01 mm), cooled to −78° C., and anhydrous HF (53.6 g, 2.65 mol) and sulfur tetrafluoride (460 g, 4.25 mol) was added (mol ratio $SF_4$ : HF = 1.6). The autoclave was sealed and heated to 100° C., then to 120° C., for a total of 296 hr. Progress of the reaction was determined by the periodic removal of samples and by gc (gas chromatography) analysis. When analysis indicated complete reaction, the noxious gases were condensed into an evacuated cylinder for reuse. The residual reaction mixture was dissolved in 300 ml methylene chloride, treated with sodium fluoride, filtered, and washed with three 200 ml portions of saturated sodium bicarbonate solution and one 200 ml portion of distilled water. The solution was dried over magnesium sulfate, and then treated with Norit A. Methylene chloride was removed under reduced pressure, to give 197 g (99% yield) of a yellow oil, which was 95.6% MFF by gc analysis. The yellow oil was distilled under vacuum at 50°-55° C. (0.01-0.02 mm), and the distillate was treated with neutral alumina (m. Woelm, W200 superactivity 1) to remove residual mixed carbonate, giving 183.7 g (93% yield) of colorless oil, ~ 99% MFF.

According to the present invention, it was further found that, if the molar amount of HF exceeds that of $SF_4$, the reaction of NOL carbonate with $SF_4$ and HF produces, in addition to MFF, the compound 1,1,1,4,4,7-hexafluoro-7,7-dinitro-3,5-dioxaheptane (TFMFF) in substantial quantities. This is illustrated in Example II.

EXAMPLE II

Mixed carbonate (10 g, 0.033 mol) was placed in a 1000-ml autoclave which was evacuated to 0.05 mm and cooled to −78° C. Anhydrous hydrogen fluoride (43.4 g, 2.2 mol) and sulfur tetrafluoride (63.5 g, 0.59 mol) were condensed into the autoclave (mol ratio $SF_4$ : HF = 0.27). The reaction mixture was heated at 100° C. (375 psi autogenous pressure) for 62 hr. After cooling to ambient temperature and venting of the toxic gases, the reaction mixture was poured into methylene chloride (200 ml) containing sodium fluoride (30 g) to remove the last traces of hydrogen fluoride. The product was treated with saturated sodium bicarbonate brine and Norit A. After removal of the methylene chloride under vacuum, a crude product (9.0 g) was obtained. By glpc (gas liquid phase chromatography) the product was about 30% impurity A, 2% impurity B, and 68% MFF. A fractional distillation was sufficient to separate the components. Impurity A was identified as TFMFF; impurity B is believed to be the precursor carbonate, $CF_3CH_2OCO_2CH_2CF—(NO_2)_2$. which is fluorinated to give Impurity A.

Date obtained in several other runs using varying $SF_4$ : HF mole ratios is given in Table I.

TABLE I

| Run | Mixed Carbonate*, g | mol | HF, g | mol | $SF_4$, g | mol |
|---|---|---|---|---|---|---|
| 1 | 10 | 0.032 | 13 | 0.65 | 70.0 | 0.65 |
| 2 | 10 | 0.032 | 40 | 2.0 | 33.5 | 0.31 |
| 3[a] | 10 | 0.032 | 25 | 1.25 | 145.8 | 1.35 |

| Run | $SF_4$ : HF mol ratio | Results after ~67 hr at 100° C |
|---|---|---|
| 1 | 1.0 | 29% MFF, 0.3% TFMFF, |
| 2 | 0.16 | 50% MFF, 13.6% TFMFF, |
| 3[a] | 1.1 | 84.6% MFF, 3.0% TFMFF |

*obtained from Naval Ordnance Laboratory, Silver Springs, White Oak, Maryland.
[a]After 137 hr, the gc showed 93.5% MFF, 5.4% TFMFF, 0.5% NOL carbonate.

The reaction which occurs when excess HF is used is described in the following equation.

$$FC(NO_2)_2CH_2OCO_2CH_2C(NO_2)F_2 \xrightarrow[\text{excess HF}]{SF_4} FC(NO_2)_2CH_2OCF_2OCH_2C(NO_2)F_2\ (MFF) + FC(NO_2)_2CH_2OCF_2OCH_2CF_3\ (TFMFF)$$

The replacement of a nitro group by fluorine under conditions of excess HF can be explained either through the direct exchange between $NO_2$ and F or by the loss of nitrous acid and subsequent addition of hydrofluoric acid.

This, for maximum yield of MFF, an $SF_4$ : HF mole ratio greater than about 1 is necessary to limit or prevent TFMFF formation. At higher ratios (8.0) of $SF_4$ : HF, the rate of the reaction is reduced. This rate reduction can be partially overcome by increasing the temperature. When HF is not in excess, high temperature does not have as deleterious an effect on the reaction as when excess HF is present. However, it is preferred to maintain the $SF_4$ : HF mole ratio below the level of about 8.0 and to conduct the reaction at a temperature below about 150° C. The preferred temperature range is from about 95° C. to about 125° C.

The reaction of mixed carbonate with $SF_4$ requires, theoretically, an $SF_4$ : carbonate mole ratio of 1 : 1. In order to insure complete reaction it is preferred to operate with an excess of $SF_4$, preferably an amount of $SF_4$ of the order of at least about 1.5 mols, most suitably in the range of from about 1.5 to about 10 moles, per mole of carbonate. After the desired concentration of $SF_4$ is determined, then the concentration of HF can be chosen subject to the above restriction that the molar amount of HF does not exceed that of $SF_4$.

The properties of MFF are given in Table II.

TABLE II

PROPERTIES OF 1,1,4,4,7-PENTAFLUORO-1,7,7-TRINITRO-3,5-DIOXAHEPTANE (MFF)

| | |
|---|---|
| Structure: | $F_2CNO_2CH_2OCF_2OCH_2CF(NO_2)_2$ |
| Molecular formula: | $C_5H_4F_5N_3O_8$ |
| Appearance: | Colorless liquid |
| Boiling point: | 39° C at 6μ |
| Melting point: | −34° C |
| Refractive index: | 1.3894 at 22° C |
| Density: | 1.68 at 23° C |
| Impact Sensitivity: | Negative, >177 cm, 2.5 kg. |

| Nmr ($CDCl_3$): | Chemical Shift | Assignment | J, Hz |
|---|---|---|---|
| Nuclear magnetic resonance) | δ 4.54 triplet | $CH_2CF_2NO_2$ | 8 ($J_{HF}$) |
| | 4.92 doublet | $CH_2CF(NO_2)_2$ | 16 ($J_{HF}$) |
| | φ* 110.0 broad triplet | CF | |
| | φ* 93.8 broad triplet | $CF_2NO_2$ | |
| | φ* 64.2 multiplet | $OCF_2O$ | |

| Analyses: | Calculated | Found |
|---|---|---|
| | C 18.25 | 18.23 |
| | H 1.22 | 1.56 |
| | N 12.77 | 12.65 |

Both MFF and TFMFF are of interest since they provide low temperature properties to explosive compositions, and, for some purposes, it may be preferable to utilize a mixture of the two compounds. Thus, the present invention provides a process for the direct preparation of such a mixture in a single reaction.

In order to prepare such a mixture, mixed carbonate is reacted with $SF_4$ and HF as in Example II, using a molar amount of HF in excess of that of $SF_4$. It is preferred to use a considerable excess of HF since an increase in the amount of HF present results in a decrease in reaction time. Also, HF acts as a solvent for the reaction. The upper limit of HF is dictated only by the size of the reactor and pressure considerations. Preferably, the mole ratio of HF : $SF_4$ is in the range of from about 1 : 1 to about 10 : 1. The difluoroformal mixture obtained under the foregoing conditions contains at least 20% by weight, generally of the order of about 30% by weight, of TFMFF.

II. 1,1,1,4,4,7-HEXAFLUORO-7,7-DINITRO-3,5-DIOXAHEPTANE (TFMFF)

To obtain this compound without the presence of MFF, the corresponding carbonate, 2-fluoro-2,2-dinitroethyl-2',2',2'-trifluoroethyl carbonate, is reacted with $SF_4$ and HF at a temperature in the range of from about 95° C. to about 150° C. as described in the following equation.

$$FC(NO_2)_2CH_2OCO_2CH_2CF_3 \xrightarrow[HF]{SF_4} FC(NO_2)_2CH_2OCF_2OCH_2CF_3$$

The starting carbonate for this reaction can be synthesized by adapting the procedure described by M. Matzner et al, *Chem. Rev.* 64 (6), 645 (1964). The synthesis is outlined in the following equation.

$$FC(NO_2)_2CH_2OCOCl + CF_3CH_2OH + C_5H_5N \rightarrow FC(NO_2)_2CH_2OCO_2CH_2CF_3$$

and exemplified as follows.

Preparation of 2-fluoro-2,2-dinitroethyl-2',2'-trifluoroethyl carbonate

Fluorodinitroethyl chloroformate (631.5 g, 2.92 mol) and trifluoroethanol (296.8 g, 2.97 mol) were dissolved in 2000 ml methylene chloride and cooled to 0°-5° C. Pyridine (229.2 g, 2.90 mol), in 400 ml methylene chloride, was added dropwise to the reaction mixture with stirring. The reaction was then stirred for an additional 30 minutes, after which ~ 1 liter of water was added and the mixture stirred overnight. The organic layer was separated and the methylene chloride evaporated leaving 798 g (97.6% yield) of a yellow liquid, which crystallized on cooling. Recrystallization of the crude solid gave 628.9 g (77% yield) of white crystalline solid, m.p. 31°-32° C.; ir (infrared) 3000 (w,C—H), 1800 (s, C—O), 1600 (s, C—$NO_2$), 1160-1340 cm−1 (s, COC-F); nmr $^1H$, 4.60 (quartet, —$CH_2CF_3$) and δ 5.33 (doublet, —$CH_2C(NO_2)_2F$).

The preparation of TFMFF from 2-fluoro-2,2-dinitroethyl-2',2',2'-trifluoroethyl carbonate is illustrated in Example III.

The fluorodinitroethyl-trifluoroethyl carbonate (529.10 g, 1.8 mol) was placed in a 1400 ml autoclave, evacuated (0.1 mm), cooled to −78° C., and anhydrous HF (146 g, 7.3 mol) and sulfur tetrafluoride (390 g, 3.6 mol) were added. The autoclave was sealed and heated to 100° C. (450 psi) for 480 hr. The progress of the reaction was followed by periodic sampling and analysis by gc. When the reaction was complete, the noxious gases were vented, and the reaction mixture was dissolved in 500 ml methylene chloride. The solution was treated with sodium fluoride, washed with saturated sodium bicarbonate solution, and stirred over a mercury-Norit A mixture. The methylene chloride was distilled off at atmospheric pressure, leaving a yellow liquid. Vacuum distillation of the crude product gave 529 g (92.7% yield) TFMFF: (99% pure, b.p. 30° C. at 0.3 mm); ir 3000 (w, C—H), 1600 (s, C—$NO_2$), 1100-1340 cm$^{-1}$ (s, COC-F); nmr $^1H$, 4.23 (quartet, —$CH_2CF_3$) and δ 4.91 (doublet, —$CH_2C(NO_2)_2F$).

Elemental analysis: Calcd for $C_5H_4N_2O_6F_6$: C, 19.88; H, 1.34; N, 9.27. Found: C, 1972; H, 1.44; N, 9.75.

As above, it is preferred to use an excess of $SF_4$ with respect to carbonate; the preferred mole ratio of $SF_4$ : carbonate is in the range of from about 1.5 : 1 to about 10 : 1. It is also preferred to use a molar amount of HF in excess of that of $SF_4$. A mole ratio of HF : $SF_4$ in the range of from about 1 : 1 to about 10 : 1 is most suitable.

The properties of TFMFF are given in Table III.

TABLE III

PROPERTIES OF 1,1,1,4,4,7-HEXAFLUORO-7,7-DINITRO-3,5-DIOXAHEPTANE (TFMFF)

| | |
|---|---|
| Structure: | $CF_3CH_2OCF_2OCH_2CF(NO_2)_2$ |
| Molecular formula: | $C_5H_4F_6N_2O_6$ |
| Molecular weight: | 302.087 |
| Appearance: | Colorless liquid |
| Boiling point: | 21° C at 6μ |
| Melting point: | −36° C |
| Refractive index: | 1.3575 at 22° |
| Density: | 1.62 at 23° |
| Impact Sensitivity: | Negative, > 177 cm, 2.5 kg |

| Nmr($CDCl_3$): Chemical Shift | Assignment | J,Hz |
|---|---|---|
| δ 4.14 quartet | $CH_2CF_3$ | 5 ($J_{HF}$) |
| 4.91 doublet | $CH_2CF(NO_2)_2$ | 16 ($J_{HF}$) |
| ϕ* 109.9 broad singlet | C-F | |
| 74.4 multiplet | $CF_3$ | |
| 63.9 broad singlet | $OCF_2O$ | |

| Analyses: | Calculated | Found |
|---|---|---|
| | C 19.88 | 19.91 |
| | H 1.34 | 1.41 |
| | N 9.27 | 9.66 |

III. 1,1,1,7,7,13,13,13-OCTAFLUORO-4,4,10,10-TETRANITRO-2,6,8,12-TETRAOXATRIDECANE (OTT)

This compound is obtained by reacting the corresponding carbonate, bis-(3-trifluoromethoxy-2,2-dinitropropyl)carbonate, with $SF_4$ and HF at a temperature in the range of from about 95° C. to about 150° C., as outlined in the following equation.

$$[CF_3OCH_2C(NO_2)_2CH_2O]_2CO \xrightarrow[HF]{SF_4} [CF_3OCH_2C(NO_2)_2CH_2O]_2CF_2$$

The starting carbonate can be prepared by adapting the procedure described in U.S. Pat. No. 3,431,290, "Preparation of Carbonate Esters", issued Mar. 4, 1969, to Thomas N. Hall, as exemplified as follows.

Preparation of bis-(3-trifluoromethoxy-2,2-dinitropropyl)carbonate 3-trifluoromethoxy-2,2-dinitropropanol (25.8 g, 0.11 mol) and phosgene (5.46 g, 0.055 mol) were combined in methylene chloride (100 ml) and cooled to 5° C. Pyridine (8.68 g, 0.11 mol) dissolved in 10 ml of methylene chloride was added dropwise with vigorous stirring to the reaction mixture. After addition the reaction was stirred for 1 hr, the methylene chloride evaporated and the remaining semisolid washed with 150 ml of water. The organic phase was separated, dissolved in 40 ml of methylene chloride, treated with magnesium sulfate, filtered and evaporated leaving 23.2 g (86% yield) of 97% pure yellow liquid; ir: 1800 (s, C—O), 1600 (s, C—$NO_2$), 1250 (s, $OCF_3$). Nmr: 4.87 (singlet, $CF_3OCH_2$—), and 5.13 δ(singlet, —$CO_2CH_2$—).

The preparation of OTT from bis-(3-trifluoromethoxy-2,2-dinitropropyl)carbonate is illustrated in Example IV.

EXAMPLE IV

The trifluoromethoxy-carbonate (20 g, 0.04 mol) was placed into a 1400-ml autoclave, evacuated (0.01 mm), cooled to −78° C., and anhydrous HF (63 g, 3.15 mol) and sulfur tetrafluoride (42.5 g, 0.4 mol) added. The autoclave was sealed and heated to 100° C. (225 psig) for 232 hr. To follow the progress of the reaction, samples were taken at 2 day intervals (total of five samples) and analyzed by HPLC (high pressure liquid chromatography) and ir. When the reaction was complete, the noxious gases were vented, and the reaction mixture dissolved in 100 ml methylene chloride. The solution was treated with sodium fluoride, filtered, washed with saturated sodium bicarbonate solution (3 × 75 ml), dried over magnesium sulfate, filtered, and treated with Norit A. The methylene chloride was removed in vacuo leaving 18.37 g of crude yellow liquid. Vacuum distillation of the crude product gave 9.8 g of OTT (99% pure, b.p. 81–83° C.)(0.01 mm).

As in the previously described reactions, the synthesis of OTT requires, theoretically, 1 mole of $SF_4$ per mole of carbonate, but it is preferred to use an excess of $SF_4$. The preferred mole ratio of $SF_4$ : carbonate is in the range of from about 1.5 : 1 to about 10 : 1. Also, it is preferred to use a molar amount of HF in excess of that of $SF_4$. A mole ratio of HF : $SF_4$ of from about 1 : 1 to about 10 : 1 is most suitable.

The properties of OTT are given in Table IV.

TABLE IV

PROPERTIES OF 1,1,1,7,7,13,13-OCTAFLUORO-4,4,10,10,-TETRANITRO-2,6,8,12-TETRAOXATRIDECANE (OTT)

Structure: $CF_3OCH_2C(NO_2)_2CH_2OCF_2OCH_2C(NO_2)_2CH_2OCF_3$
Molecular Formula: $C_9H_8F_8N_4O_{12}$
Formula Weight: 516.2
Appearance: Colorless liquid
Boiling Point: 81–83° C (0.01 mm)
Refractive Index: $n^{21}$ D 1.3905
Density: 1.665 (23° C)
Heat of Formation: −544.7 Kcal $mol,^{-1}$ −105.5 Kcal 100 $g^{-1}$
Balanced to: 8HF, 6CO, $3CO_2$, $2N_2$
Impact Sensitivity: Negative, 177 cm, 2.5 kg.

| Elemental Analyses: | Calc'd | Found |
|---|---|---|
| | C: 20.94 | 21.02 |
| | H: 1.56 | 1.51 |
| | N: 10.85 | 10.70 |

Nmr: $H^1(CDCl_3)$:

| | Chemical Shift | Assignment |
|---|---|---|
| | δ 4.80 singlet | $—CF_2OCH_{-2}C(NO_2)_2—$ |
| | δ 4.88 singlet | $CF_3OCH_{-2}C(NO_2)—$ |
| $F^{19}(CFCl_3)$: | ϕ* 62.5 singlet | $CF_{-3}O$ |
| | ϕ* 65.0 singlet | $OCF_{-2}O$ |

Certain precautions must be taken in the conduct of the operations described herein due to the explosive and toxic nature of the reactants. Most particularly, all operations should be conducted remotely; reactors should be charged in a hood under vacuum and in a closed system. During actual runs, the reactors should be housed in a structure which can withstand the shock of possible explosions, and the structure should be vented to prevent buildup of noxious gases. The carbonate reactants and difluoroformal products described herein are relatively insensitive to impact and can be handled in the absence of a solvent; however, as an extra safety precaution, these materials may be dissolved in a suitable solvent such as methylene chloride. The reactions can be conducted with or without a solvent. If the carbonates and difluoroformals are to be stored for an extended period of time, they should be stored in a solvent such as methylene chloride.

As shown in Tables II, III, and IV, impact sensitivity tests on the difluoroformals of the present invention gave negative results, using a 2.5 kg drop-weight, at 177 cm, the limit of the testing apparatus used, indicating relative insensitivity to impact. (The impact sensitivity value for a given sample is the height from which the specified weight is dropped for the probability of explosion to be 50 percent. This value is an indication of the handling safety of the material being tested.)

it is desirable that plasticizers for explosive compositions remain liquid over a wide temperature range so as to avoid phase changes, which might disrupt the explosive, over the temperature range of normal use. For some applications, normal usage may involve a temperature range as great as from −65° F. to +165° F. In this respect, the present difluoroformals are particularly suitable as plasticizers because of their low melting points. The melting points of MFF, TFMFF, and a mixture thereof are compared with those of the related compounds FEFO and difluoro-FEFO in Table V.

TABLE V

| Compound | FEFO | DIFLUORO-FEFO | MFF | TFMFF | Mixture 50% MFF + 50% TFMFF |
|---|---|---|---|---|---|
| m.p., ° C | 14° C | −17° C | −34° C | −36° C | −50° C |

Although the invention has been described with respect to preferred embodiments, it is to be understood that various modifications and changes may be made therein without departing from the true spirit and scope of the invention. Thus, it is not intended to limit the invention except by the terms of the following claims.

What we claim is:

1. A nitroaliphatic difluoroformal of the formula $RCH_2OCF_2OCH_2R'$ wherein R = $FC(NO_2)_2$— and R' = $F_2C(NO_2)$— or $CF_3$—; or R = R' $CF_3OCH_2C(NO_2)_2$—.

2. A nitroaliphatic difluoroformal according to claim 1 wherein R = $FC(NO_2)_2$— and R' = $F_2C(NO_2)$— or $CF_3$—.

3. The compound 1,1,4,4,7-pentafluoro-1,7,7-trinitro-3,5-dioxaheptane.

4. The compound of 1,1,1,4,4,7-hexafluoro-7,7-dinitro-3,5-dioxaheptane.

5. The compound 1,1,1,7,7,13,13,13-octafluoro-4,4,10,10-tetranitro-2,6,8,12-tetraoxatridecane.

6. An energetic plasticizer composition comprising 1,1,4,4,7-pentafluoro-1,7,7-trinitro-3,5-dioxaheptane and 1,1,1,4,4,7-hexafluoro-7,7-dinitro-3,5-dioxaheptane.

* * * * *